US010065830B2

(12) United States Patent
Durr

(10) Patent No.: US 10,065,830 B2
(45) Date of Patent: Sep. 4, 2018

(54) CONTROL APPARATUS AND METHOD FOR CONTROLLING A PRINTED-PRODUCT PROCESSING SYSTEM

(75) Inventor: Matthias Durr, Rapperswil (CH)

(73) Assignee: FERAG AG, Hinwil (CH)

( * ) Notice: Subject to any disclaimer, the term of this patent is extended or adjusted under 35 U.S.C. 154(b) by 713 days.

(21) Appl. No.: 13/514,911

(22) PCT Filed: Dec. 2, 2010

(86) PCT No.: PCT/CH2010/000305

§ 371 (c)(1),
(2), (4) Date: Aug. 17, 2012

(87) PCT Pub. No.: WO2011/069269

PCT Pub. Date: Jun. 16, 2011

(65) Prior Publication Data

US 2012/0310402 A1 Dec. 6, 2012

(30) Foreign Application Priority Data

Dec. 9, 2009 (CH) ..... 01893/09

(51) Int. Cl.
*B65H 39/02* (2006.01)
*B65H 29/60* (2006.01)
*B65H 43/00* (2006.01)

(52) U.S. Cl.
CPC ..... *B65H 39/02* (2013.01); *B65H 29/60* (2013.01); *B65H 43/00* (2013.01); *B65H 2301/437* (2013.01); *B65H 2511/414* (2013.01)

(58) Field of Classification Search
None
See application file for complete search history.

(56) References Cited

U.S. PATENT DOCUMENTS 4,552,349 A * 11/1985 Loos et al. ..... 270/52.03
4,850,104 A * 7/1989 Matrone et al. ..... 29/829
5,434,790 A * 7/1995 Saka et al. ..... 700/110
(Continued)

FOREIGN PATENT DOCUMENTS

EP 1 338 542 A1 8/2003

OTHER PUBLICATIONS

Office Action issued in Canadian Patent Application No. 2,783,486, dated Mar. 28, 2017.

*Primary Examiner* — Mohammad Ali
*Assistant Examiner* — Saad M Kabir
(74) *Attorney, Agent, or Firm* — Knobbe, Martens, Olson & Bear, LLP

(57) ABSTRACT

For controlling a printed product processing system, which comprises a collecting system having a conveyor and a plurality of feed conveyors for creating product collections from products fed by the feed conveyors, system configuration parameters which define a configuration of the printed product processing system and production configuration parameters which define the production of product collections created from a plurality of products fed are detected and run time data are determined during the production. On the basis of the system configuration parameters, the production configuration parameters and the run time data, one of a plurality of defined production strategies, which in each case determine the control of the printed product processing system, is selected during the production.

23 Claims, 5 Drawing Sheets

(56) References Cited

U.S. PATENT DOCUMENTS

| | | | | |
|---|---|---|---|---|
| 6,227,377 | B1 * | 5/2001 | Bonnet | B65G 21/12 198/435 |
| 6,269,609 | B2 * | 8/2001 | Graushar et al. | 53/168 |
| 7,845,485 | B2 | 12/2010 | Honegger | |
| 7,933,674 | B2 * | 4/2011 | Driskill et al. | 700/117 |
| 2004/0073330 | A1 | 4/2004 | Bader et al. | |
| 2007/0126578 | A1 * | 6/2007 | Broussard | 340/572.1 |

* cited by examiner

CONTROL APPARATUS AND METHOD FOR CONTROLLING A PRINTED-PRODUCT PROCESSING SYSTEM

This application is the U.S. National Phase under 35 U.S.C. § 371 of International Application No. PCT/CH2010/000305, filed Dec. 2, 2010, which claims priority to Swiss Application No. 01893/09, filed Dec. 9, 2009.

TECHNICAL FIELD

The present invention relates to a computerized control device and a computer-implemented method for controlling a printed product processing system. The present invention relates, in particular, to a computerized control device and a computer-implemented method for controlling a printed product processing system, which comprises a collecting system having a conveyor and a plurality of feed conveyors for creating product collections from products, in particular printed products, fed by the feed conveyors.

PRIOR ART

In known collecting systems for collecting (in the broader sense) product collections composed of a plurality of products by collating, inserting or collecting (in the narrower sense), the different products are fed by a plurality of serially arranged feed conveyors sequentially to a conveyor, where they are collated, inserted or collected, for example on or respectively in collection carriers such as grippers. In the case of printed product processing systems, the products comprise, in particular, planar printed products of varying thickness but also other planar products such as, for example, data carries or other inserts. The product collections created from the products are fed by the conveyor sequentially to one or a plurality of further processing systems, for example for inserting, film wrapping, stitching, bonding, cutting and/or stacking. Typically, a collecting system designed for collating products is embodied with a circulating conveyor. A circulating conveyor makes it possible to transport products, product collections or respectively collection carriers along a closed curve cyclically past the product-feeding feed conveyors. Consequently, specific products or respectively product collections can pass through a plurality of cycles on the circulating conveyor, such that they are multiply fed to the collating process before being transferred to a further processing system.

At high conveying speeds and correspondingly high feeding speeds and high product throughput quantities, even small faults in compiling the product collections, for example when a product fails to be fed on account of a withdrawal fault at the responsible feed conveyor, in particular as a result of the addition of such faults, bring about considerable quantities of faulty collections which, depending on the quality requirements, have to be disposed of as rejects or sorted out in a complicated manner, i.e. manually, and fed to the process once again. For this purpose, all including faulty collections are identified and tracked and the faulty collections, upon reaching a reject diverter, are fed to a reject removal system, for example by dropping through the relevant collection carrier. However, the circulating embodiment of the conveyor makes it possible as an alternative to guide faulty collections, in particular incomplete collections with missing products, for completion in each case past the further processing systems and reject diverters, in a further cycle on the circulating conveyor, past the product-feeding feed conveyors once again. However, product collections returned into the process in this way often adversely affect the net performance of the collecting system and thus of the printed product processing system, since they cause empty rounds particularly during successive production of differently structured product collections.

However, the high conveying speeds and correspondingly high feeding speeds and high product throughput quantities necessary in the case of printed product processing systems make not just the treatment of production faults but generally any adaptations to changes in production conditions and production requirements during the production, i.e. at the production time, a major challenge. In the case of printed product processing systems it is necessary to satisfy the at least in part conflicting requirements of high-speed mass production and temporally changing through to individualized product and/or collection requirements.

EP 1 338 542 describes, for a collecting system having a plurality of feed conveyors, determining, in a manner preceding the production, optimum batch sequences which enable the product occupancy in the feed conveyors to be changed in a manner as small as possible.

US 2004/0073330 describes a collecting system, for example for newspaper, which is controlled by a central control computer. The central control computer receives sensor information from system parts and calculates, on the basis of said information, an optimum total throughput rate in real time. The control computer additionally determines which system elements have to be set differently in order to achieve the optimum total throughput rate, and performs the corresponding adaptations. The document additionally describes a task table with functions which are performed at a definable point in time and which are arranged in the sequence to be performed. The task table is loaded at the beginning of the production and if the user changes the configuration of the machine, the task table is correspondingly adapted, for example by removal or respectively addition of functions and changing of the sequence of performance.

EP 2 107 023 describes the automated activation of a repair mode when detecting a fault in the sequence of a product stream created from planar products. The repair mode is activated for the product stream by means of a control unit connected to the conveyor if said control unit, on account of the type of a detected product, ascertains a deviation from a stored sequence or receives a fault message about an absent or faulty product. In the repair mode, the issuing of new products onto the conveyor is interrupted and the products already placed on the conveyor are conveyed back to the grouping section again along a closed trajectory and the resulting gap(s) and possible empty rounds on the conveyor are accepted.

SUMMARY OF THE INVENTION

It is an object of the present invention to propose a computerized control device and a computer-implemented method for controlling a printed product processing system comprising a collecting system which do not have at least some disadvantages of the known systems. In particular, it is an object of the present invention to propose a computerized control device and a computer-implemented method for controlling a printed product processing system comprising a collecting system which enable an optimization of the production and, in particular, an optimum treatment of faulty collections which takes account of a quality requirement of the product collections, on the one hand, and the performance of the printed product processing system, on the other hand.

According to the present invention, these aims are achieved, in particular, by means of the elements of the independent claims. Further advantageous embodiments are additionally evident from the dependent claims and the description.

The abovementioned aims are achieved by the present invention in particular by virtue of the fact that for controlling a printed product processing system, which comprises a collecting system having a conveyor and a plurality of feed conveyors for creating product collections from products fed by the feed conveyors, system configuration parameters which define a configuration of the printed product processing system are detected and stored in a computerized control device, that production configuration parameters which define the production of product collections created from a plurality of products fed are detected and stored in the computerized control device, that run time data are determined during the production in the computerized control device, that one of a plurality of defined production strategies, which in each case determine the control of the printed product processing system and which comprise stored instructions and/or control parameters for controlling the printed product processing system, is dynamically selected in the computerized control device during the production on the basis of the stored system configuration parameters, the stored production configuration parameters and the run time data determined, and that the selected stored production strategy for controlling the printed product processing system is activated. In this case, the run time data, following the term "run time" used particularly in information technology, are data, in particular data values, which arise (dynamically) at the production time, that is to say during the productive operation of the printed product processing system, and are not yet defined (static) before the commencement of the production, that is to say before the operation of the printed product processing system. The term run time should not be understood in the sense of a measured time duration, but rather as the production time, i.e. the time period in which the printed product processing system runs productively. The values of run-time-dependent parameters or variables are accordingly not known before the commencement of the production, but rather are only defined at the production time by the corresponding current run time data.

The automatic selection of a production strategy for the control of the printed product processing system during the production on the basis of the system configuration and product configuration and run time data enables a dynamic adaptation of the creation and further processing of product collections to current events, states and/or configurations of the printed product processing system. In short, the automatic selection of a production strategy enables a dynamic adaptation of the production to altered boundary conditions in the production and in the production system. In contrast to the prior art, therefore, it is not simply the case that when detecting a production fault in a repair mode the issuing of new products onto the conveyor is interrupted and already placed products are conveyed back along a closed trajectory, rather it is possible to activate dynamically a wide variety of defined production strategies which are selected flexibly depending on the current configurations of the printed product processing system.

Preferably, at least certain run-time-dependent system configuration parameters or respectively production configuration parameters are detected and stored during the production. Detecting system configuration parameters or respectively production configuration parameters as run time data enables a dynamic adaptation of the creation and further processing of product collections in real time or near to real time to run-time-dependent and/or user-specified system conditions and/or production variables of the printed product processing system. In contrast to the prior art, therefore, it is not simply the case that when detecting a production fault a repair mode is activated, rather it is possible to select and activate dynamically a wide variety of defined production strategies depending on changes in the configurations of the printed product processing system during the production.

In one embodiment variant, the run time data indicate a production fault that has occurred in the creation of a product collection, and the defined production strategy is selected depending on the detected production fault on the basis of the system configuration parameters and the production configuration parameters. The run time data indicate, for example, a detected fault in the compiling of a product collection, e.g. a product missing in the product collection. The automatic selection of a production strategy for the control of the printed product processing system in the case of faulty collections on the basis of the system and product configuration of the printed product processing system enables a dynamic adaptation of the fault treatment in the printed product processing system to run-time-dependent and/or user-specified system conditions and/or production variables of the printed product processing system.

In a further embodiment variant, the run time data are input by a user during the production via a user interface, e.g. by addition, amendment and/or erasure, and are stored. The free inputting of, for example, user-specific run time data during the production affords an efficient and flexible possibility of dynamically influencing the creation and further processing of product collections. By way of example, it is thus possible to input current weather indications for specific geographical areas, for which then at the production time weather-dependent routes or respectively addresses for the provision, arrangement and delivery of the product collections are determined and activated. In addition or as an alternative, such run time data can also be supplied and determined by a computerized data source via a communication interface.

In one embodiment variant, the defined production strategies bring about a different driving of the feed conveyors for a different feeding of the products. The different production strategies are designed, for example, such that they bring about such a different control of the printed product processing system upon the detection of an incomplete product collection with a missing product that, by the feed conveyors, further products are fed to the incomplete product collection in the course of further guidance on the conveyor, no further products are fed thereto and/or only selected further products are fed thereto for creating the product collection with a different structure (collection conversion).

In a further embodiment variant, the defined production strategies bring about a different driving of a transfer unit, which transfers a created product collection to a further processing system or leaves it on a circulating conveyor and guides it past the feed conveyors once again. The different production strategies are designed, for example, such that they bring about such a different control of the printed product processing system upon the detection of an incomplete product collection with a missing product that the incomplete product collection, for completion with the missing product in one (or a plurality of) additional cycle(s), is guided past the relevant feed conveyors once again on the circulating conveyor, or is separated for manual completion or as a reject.

In a further embodiment variant, the defined production strategies bring about a different driving of a reject diverter, which feeds a faulty product collection to a reject removal system or guides it further on the conveyor.

In one embodiment variant, the defined production strategies bring about a different speed control of the conveyor, which bring about different speeds of the conveyor.

The system configuration parameters comprise, for example, indications about the number of feed conveyors, the position of the feed conveyors (in relation to the conveyor), the number of collection carriers, the number of connectable stacking stations, the position of the connectable stacking stations, the number of reject diverters or respectively reject removal systems and/or the position of the reject diverters or respectively reject removal systems.

The production configuration parameters comprise, for example, indications about the number of product collections to be produced, route information for the delivery of packs with product collections, address information for the delivery of packs or respectively product collections, indications about the number of empty positions on the conveyor between the production of different product collections, e.g. the number of empty collection carriers between the successive production of different product collections, indications about the number of product collections in additional production (redundancy), the structure of a product collection (order and type of the products in a product collection), the size of a product collection, the number of products, the occupancy of the feed conveyors, split operation of feed conveyors (that is to say the occupancy of a plurality of feed conveyors with the same products, e.g. for efficient feeding in the case of thick products or as redundant backup for failures of feed conveyors), the treatment of superfluous collections and/or the fault tolerance, e.g. the tolerance of incorrect withdrawals per product, the tolerance of product collection faults, the tolerance of pack faults, the tolerance of faults in the product order, the tolerance of additional products in a product collection and/or the tolerance with regard to route conformity of packs and/or the order of packs. In this case, route conformity relates to the fact that the stacking of the product collections in packs and/or the order in the arrangement of created packs are/is effected in accordance with defined route information or respectively addresses for an efficient delivery of the packs or respectively product collections.

In one embodiment variant, configuration conditions assigned to the defined production strategies are stored, which comprise defined minimum and/or maximum values for specific system configuration parameters and/or production configuration parameters, and the defined production strategies are selected in each case depending on whether the assigned configuration conditions are met. In one variant, the fact that configuration conditions are not met can also result in deactivation of the corresponding production strategy or strategies. The system configuration parameters comprise, for example, the number of stacking stations for stacking product collections, i.e. for pack formation, which can be connected to the conveyor, and one of the configuration conditions defines a minimum value for the number of stacking stations which are required for a specific production strategy, for example two, such that this production strategy cannot be selected if the printed product processing system is configured for example just with one stacking station or if just one stacking station is available at the production time.

In a further embodiment variant, a respective strategy assessment assigned to the defined production strategies is stored, and the defined production strategy is selected on the basis of the assigned strategy assessment. The strategy assessment comprises, for example, a strategy priority value, an expected rejects value and/or an expected performance value. The assignment of strategy assessments to production strategies enables a corresponding classification of the production strategies for example into preferred or less preferred production strategies, and/or into those having high or low rejects of faulty collections, or respectively those having high or low production performance (production spread, product throughput quantity). This classification of the production strategies enables a dynamic selection of the production strategies on the basis of corresponding production configuration parameters which define, in a user-specified manner, for example, a preferred strategy assessment, for example a preferred rejects value and/or performance value.

Preferably, at least certain user-specific system configuration parameters or respectively production configuration parameters are detected via a user interface, e.g. by addition, amendment and/or erasure, and stored. The detection of user-specific system configuration parameters or respectively production configuration parameters enables the flexible adaptation of the production, in particular in the case of the fault treatment, in the printed product processing system to user-specified production variables of the printed product processing system.

Besides a computerized control device and a computer-implemented method for controlling a printed product processing system, the present invention relates, moreover, to a computer program product comprising a computer-readable storage medium with stored computer code. The computer code is designed to control one or a plurality of processors of the control device such that the processors or respectively the control device detect and store system configuration parameters which define a configuration of the printed product processing system, detect and store production configuration parameters which define the production of product collections created from a plurality of products fed, determine run time data during the production, and dynamically select one of a plurality of defined production strategies, which in each case determine the control of the printed product processing system, during the production on the basis of the system configuration parameters, the production configuration parameters and the run time data.

BRIEF DESCRIPTION OF THE DRAWINGS

An embodiment of the present invention is described below on the basis of an example. The example of the embodiment is illustrated by the following enclosed figures.

WAYS OF EMBODYING THE INVENTION

Figure 1:
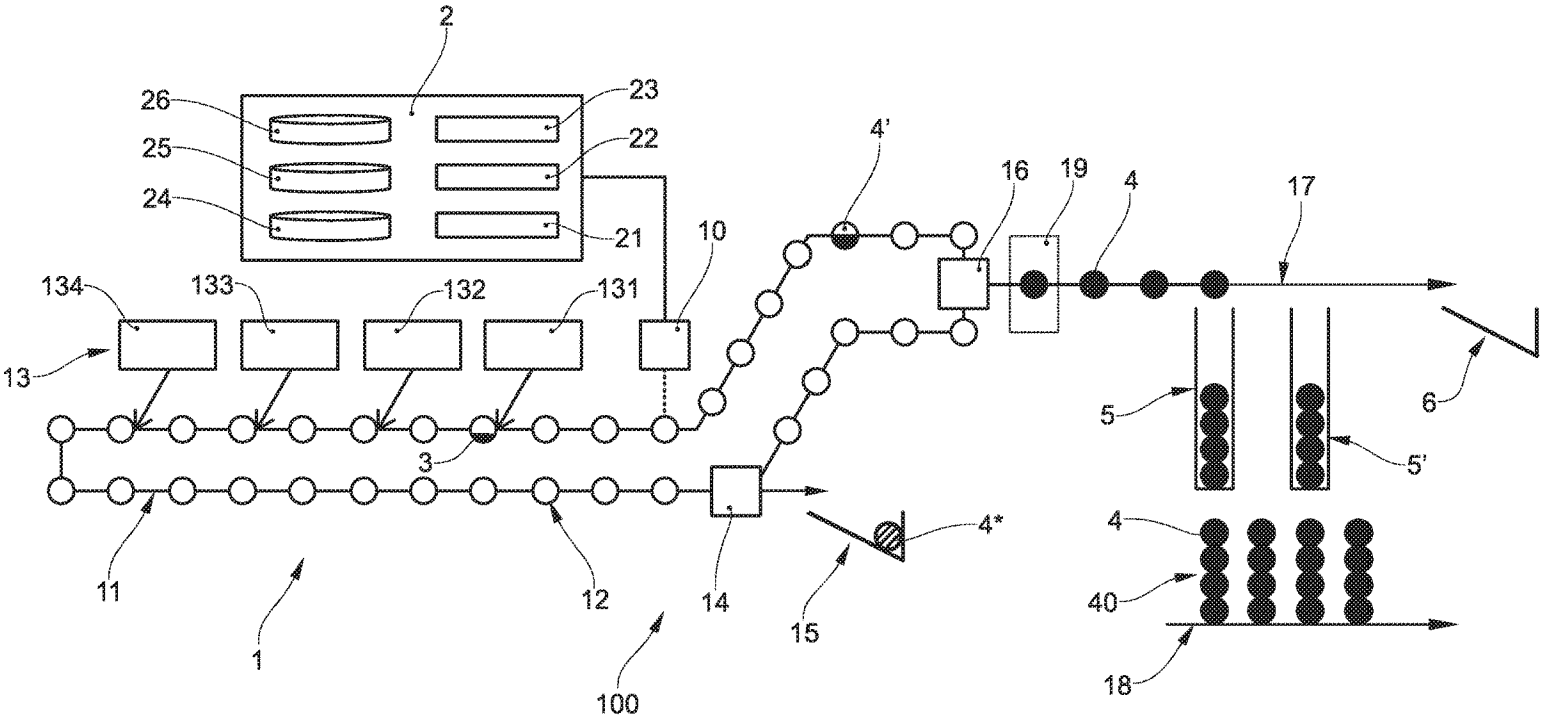
FIG. 1: shows a block diagram of a schematically illustrated computer-controlled printed product processing system comprising a collecting system having a conveyor and a plurality of feed conveyors for creating product collections.

In FIGS. 1 to 5, the reference sign 100 refers to a computer-controlled printed product processing system comprising a collecting system 1. The collecting system 1 comprises at least one conveyor 11 and a plurality of feed conveyors 13 which feed respectively different products 3 to the conveyor 11 depending on their product occupancy. Depending on the application, a plurality of feed conveyors 13 are occupied by the same product (split operation), for example in the case of thick products, where the manual equipping of an individual feed conveyor 13 is too slow to cover the uninterrupted feeding of products 3 to the conveyor 11 by a single feed conveyor 13.

FIGS. 1 to 5 illustrate just four feeding feed conveyors 131, 132, 133, 134 for simplification; in one practical embodiment, the collecting system 1 of the printed product processing system 100 comprises a much greater multiplicity of feed conveyors 13, for example several dozen or more than one hundred. In different embodiment variants, the collecting system 1 is designed to create, by collating, inserting or collecting products or by other product-combining operations, combinations of products, which we designate here as product collections, and correspondingly comprises a conveyor 11 having a circulating collating section, a collecting drum, a belt conveyor for collating imbricated streams, or a collecting section, in each case with or without a collection carrier, for example grippers.

The example of the collecting system 1 illustrated in FIGS. 1-5 comprises a conveyor 11 having a plurality of serially arranged collection carriers 12, for example grippers, which are guided along a closed line cyclically past the feed conveyors 13 and take up the products 3 fed. As a result of the sequential feeding of the products 3, a product collection 4 is compiled on the conveyor 11, in particular on or respectively in the collection carriers 12.

The printed product processing system 100 additionally comprises at least one reject diverter 14, which feeds faulty product collections 4* away from the conveyor 11 to a reject removal system 15. Faulty product collections 4* are detected by various sensors (not illustrated) in the printed product processing system 100.

The reference sign 16 designates a controllable transfer unit, which feeds the completely compiled product collections 4 via a further conveyor 17, for example a chain conveyor with grippers, to a stacking station 5, which creates a pack 40 having a defined number of product collections 4 and feeds it to an outgoing conveyor 18, for example a belt conveyor, in order to be transported away.

As is illustrated schematically in FIGS. 1-5, the printed product processing system 100 comprises in different embodiment variants in addition to the stacking station 5 one or a plurality of further processing systems 19 disposed downstream of the transfer unit 16, for example. Such further processing systems 19 comprise, for example, a packaging system, e.g. a film wrapping system, a system for inserting additional products or product collections 4 into a main product, a system for stitching and/or cutting, a system for bonding and/or cutting, and a system for imprinting or sticking on additional information such as, for example, name and address. Depending on the embodiment variant and system configuration, a plurality of stacking stations 5, 5' are connected to the collecting system 1.

Depending on the embodiment variant and production situation, the conveyor 17 feeds excess product collections 4 to a discharge station 6.

Depending on the embodiment variant and production control, the controllable transfer unit 16 guides incompletely compiled collections 4' on the conveyor 11 for completion of the incomplete collection 4' on an additional further cycle on the conveyor 11 past the feeding feed conveyors 13.

For counting products 3 fed, faulty product collections 4*, complete and excess product collections 4, and/or created packs 40, the printed product processing system 100 additionally comprises various counters (not illustrated).

The person skilled in the art will understand that the printed product processing system 100 illustrated in FIGS. 1 to 5 can comprise in further embodiment variants or respectively system configurations further components and/or other arrangements, for example a further controllable transfer unit 16 and/or a different design of the conveyor 17, which enable separation and/or slowed-down conveyance for manual completion of an incomplete collection 4' with missing products 3.

For control purposes, the printed product processing system 100 comprises a control computer 10, which is connected to the various components and units of the printed product processing system 100 via communication connections, in particular to the conveyor 11 of the collecting system 1, the feeding feed conveyors 13, the reject diverter 14, the controllable transfer unit 16, the further processing system 19, the stacking stations 15, 15', the different further conveyors 17, 18 and the sensors and counters mentioned.

The control computer 10 is designed to track (tracking information) the product collections 4 conveyed on the conveyor 11 or respectively the incomplete collections 4' with regard to their positions on the conveyor 11, their content and structure (i.e. products and order), the envisaged and/or changed collection type (with specific collection structure), and/or the number of cycles run through on the conveyor 11. To create individualized product collections 4 provided, for example, with an individual address of a recipient and/or in terms of content with content and thus structure of the product collection geared individually to the relevant recipient, a product collection 4 can be identified and tracked over its entire creation time from the first feeding feed conveyor 13 on the conveyor 11 until stacking on a specific pack 40 in the printed product processing system 100.

The reference sign 2 refers to a computerized control device embodied as part of the control computer 10 or on a separate computer. As is illustrated schematically in FIGS. 1 to 5, the control device 2 comprises various function modules, in particular a system configurator (system configuration module) 21, a production configurator (production configuration module) 22 and a strategy selector (strategy selection module) 23, and data memory or respectively program memory for storing system configuration parameters 24, production configuration parameters 25 and production strategies 26. The function modules are preferably embodied as programmed software modules which comprise computer program code for controlling one or a plurality of processors of one or a plurality of computers.

The computer program code is stored on one or a plurality of (tangible) computer-readable storage media connected to the processors fixedly or removably. The person skilled in the art will understand, however, that the function modules in alternative embodiment variants can be embodied in part or completely by hardware components.

The control device 2 and/or the control computer 10 are/is preferably connected to a superordinate computerized supervisory control system (not illustrated).

The system configurator 21 is designed to detect and to store system configuration parameters 24 which define the configuration of the printed product processing system 100.

The system configuration parameters 24 comprise, for example, indications about the number, the type and/or the function of the feed conveyors 3, the position of the feed conveyors 3 on the conveyor 11, e.g. a sequential position number, the number and, if appropriate, type of the collection carriers 12 of the conveyor 11, the number and the type of operationally available and/or connectable stacking stations 5, 5', the position of the connectable stacking stations 5, 5' with respect to the conveyor 17, the number of reject diverters 14, the position of the reject diverters 14, the number and type (function) of the further processing systems 19 and/or the position of the further processing systems 19.

The system configurator 21 preferably comprises a (for example graphical) user interface with display and operating elements for inputting the system configuration parameters 24, for example during the installation of the printed product processing system 100, during preparation for the production and/or during the production. System configuration parameters 24 which are input during the production are therefore run time data which determine the dynamic selection of a production strategy 26. That is to say that by inputting the above-described system configuration parameters 24 by addition, amendment and/or erasure, it is possible to influence the selection of the production strategy 26 during the production time.

In one variant, the system configurator 21 is additionally designed to detect and to store at least certain system configuration parameters 24 automatically by interrogation via a communication channel from the different components of the printed product processing system 100, on the one hand static but on the other hand also run-time-dependent system configuration parameters 24 of the printed product processing system 100, whereby the system configuration is automatically updated at the production time in particular also with regard to available or respectively failing system components. The dynamic detection of run-time-dependent system configuration parameters 24 is effected, for example, periodically and/or upon enquiry or respectively user instruction.

The production configurator 22 is designed to detect and to store production configuration parameters 25 which define at least one production series for compiling product collections 4 composed of a plurality of products 3 fed. In this case, a production series is a production run for compiling product collections 4 having a specific collection type, i.e. a specific collection structure, wherein a production run has a production start and a production end and can comprise a plurality of different production series. Alongside information for creating product collections 4 and packs 40, the production configuration parameters 25 also comprise, in particular, customer-specific indications (specifications) concerning product quality or respectively permissible fault tolerance in the production and concerning the delivery of the packs 40 or respectively product collections 4.

In one variant, at least certain production configuration parameters from among the production configuration parameters 25 are communicated to the product configurator 22 by the superordinate supervisory control system.

The production configuration parameters 25 comprise, for example, indications about the structure of a product collection 4, that is to say the number and, if appropriate, the prescribed order of products 3 in a product collection 4, the size of a product collection 4, the number of product collections 4 in a production or respectively production series, route information for the efficient delivery of packs 40 with product collections, address information for the delivery of packs 40 or respectively product collections 4, the number of empty positions, for example empty collection carriers 12, between two production series succeeding one another in a production run for creating different product collections 4, the occupancy of the feed conveyors 13, that is to say the order and number of products 3 of a specific product type on a relevant feed conveyor 13, and/or the split operation of two or more feed conveyors 13 with occupancy by the same products 3.

The route information or respectively address information for the delivery of packs 40 with product collections 4 comprises an assignment of packs 40 to defined delivery sequences or geographical positions, for example an assignment of packs 40 with product collections 4 of a specific collection structure to specific routes, addresses or zones. In one embodiment variant, the route information or respectively address information for the delivery of packs 40 additionally comprises assigned weather indications which, for specific geographical areas, enable an automatic weather-dependent route selection or respectively address selection at the production time.

Depending on the embodiment variant, the production configuration parameters 25 comprise, moreover, indications about the number of product collections 4 in additional production for a production or respectively a production series, that is to say the planned number of additional (redundant) product collections 4 above the defined desired production, the tolerance of incorrect withdrawals per product 3 overall and/or for each feed conveyor 13, the tolerance of pack faults, the tolerance of collection faults, e.g. the tolerance of faults of the product series or additional products 3 in a product collection 4, the conditions with regard to production volume or respectively production speed, the treatment of excess product collections 4 produced, and/or the tolerance with regard to route conformity of packs and/or the order of packs.

The production configurator 22 preferably comprises a (for example graphical) user interface with display and operating elements for inputting the production configuration parameters 25, for example during preparation for the production and/or during the production. Production configuration parameters 25 which are input during the production are therefore run time data which determine the dynamic selection of a production strategy 26. That is to say that by inputting (adding, amending and/or erasing) the above-described production configuration parameters 25 or other production configuration parameters, such as, for example, current weather indications for specific geographical areas, it is possible to influence the selection of the production strategy 26 during the production time, for example the selection of the routes or respectively addresses for the delivery of the packs 40, 40*a*, 40*b* with product collections and thus the suitable creation of the packs 40, 40*a*, 40*b* and their order or respectively arrangement for an efficient route-specific delivery. In one variant, even the order of the product collections 4, 4*a*, 4*b* in the packs 40, 40*a*, 40*b* is determined for an efficient route-specific delivery. By way of example, for the production of the packs or respectively product collections the delivery route selected in the case of sunny weather may be different from that selected in the case of rainy weather.

The production strategies 26 in each case comprise executable and/or interpretable instructions and/or control parameters for controlling the printed product processing system 100 in the case of specific situations, states and events during the production or respectively a production series, that is to say depending on a wide variety of run time data such as production configuration parameters 25 input during the production time, system configuration parameters 24 or weather data, or fault-indicating run time data such as system faults or production faults.

The production strategies 26 comprise, in particular, stored instructions and/or control parameters for controlling components of the printed product processing system 100, for example for controlling the conveyor 11, individual feed conveyors 131, 132, 133, 134, the reject diverter 14, the controllable transfer unit 16, the further processing system 19, the conveyors 17, 18 and/or the stacking stations 5, 5' in the case of defined run-time-specific scenarios, constellations, configurations and events, in particular upon the occurrence of defined fault situations and fault states when compiling a product collection 4 or respectively feeding a product 3 to a product collection 4.

Preferably, the selected production strategies 26 for controlling the printed product processing system 100 are executed on the control computer 10 or are respectively interpreted by the control computer 10 or their control parameters are evaluated on the control computer 10. The person skilled in the art will understand, however, that in alternative embodiment variants at least certain instructions and/or control parameters of the selected production strategies 26 can be executed, interpreted or evaluated in distributed fashion by processors of other computerized components of the printed product processing system 100.

In one embodiment variant, a respective strategy assessment assigned to the defined production strategies 26, as illustrated in table 1, is stored, for example a strategy priority value $P_1$, $P_n$, an expected rejects value $A_1$, $A_n$ and/or an expected performance value $L_1$, $L_n$.

The strategy priority value $P_1$, $P_n$ is, for example, an index or measure of the degree to which the assigned production strategy $PS_1$, $PS_n$ is generally preferred or respectively subordinated relative to other production strategies $PS_1$, $PS_n$.

The expected rejects value $A_1$, $A_n$ is an index or measure of the degree to which the assigned production strategy $PS_1$, $PS_n$ is geared to feeding faulty product collections 4*, in particular incomplete collections 4' with failed product feeding, via the reject diverter 14 to the reject removal system 15, or conversely the degree to which the assigned production strategy $PS_1$, $PS_n$ is geared to correcting incomplete collections 4' with failed product feeding by conversion into a different collection type and/or completion by return via the controllable transfer unit 16.

The expected performance value $L_1$, $L_n$ is an index or measure of the degree to which the assigned production strategy $PS_1$, $PS_n$ is geared to keeping the production times (production duration) as short as possible or respectively the production throughput and the production speed as high as possible, by treating faulty collections 4*, in particular incomplete collections 4' with failed product feeding, as far as possible without additional production steps, in particular without empty production cycles.

The strategy priority value $P_1$, $P_n$, the expected rejects value $A_1$, $A_n$ and the expected performance value $L_1$, $L_n$ are, for example, ranking values from a defined ranking scale having a range of values between a lowest rank, e.g. one, and a highest rank, e.g. ten. Corresponding (e.g. user-specified) indications in the production configuration parameters with regard to preferred strategy assessments, in particular with regard to strategy priority values, rejects values and/or performance values, enable a selection in this regard of the production strategies 26 by the strategy selector 23.

TABLE 1

| | Strategy assessment | | | Configuration conditions | | | | |
|---|---|---|---|---|---|---|---|---|
| | | | | System configuration parameter | | | Production configuration parameter | |
| Production strategy | Strategy priority value | Rejects value | Performance value | Minimum value | Maximum value | ... | Minimum value | Maximum value |
| $PS_1$ | $P_1$ | $A_1$ | $L_1$ | $SK_{11min}$ | $SK_{11max}$ | ... | $SP_{1qmin}$ | $SP_{1qmax}$ |
| ... | ... | ... | ... | ... | ... | ... | ... | ... |
| $PS_n$ | $P_n$ | $A_n$ | $L_n$ | $SK_{n1min}$ | $SK_{n1max}$ | ... | $SP_{nqmin}$ | $SP_{nqmax}$ |

In one embodiment variant, in each case one or a plurality of configuration conditions assigned to the defined production strategies $PS_1$, $PS_n$ as illustrated in Table 1, were stored. The configuration conditions in each case comprise defined minimum and/or maximum values $SK_{11min}$, $SK_{11max}$, $SP_{1qmin}$, $SP_{1qmax}$, $SK_{n1min}$, $SK_{n1max}$, $SP_{nqmin}$, $SP_{nqmax}$, for specific system configuration parameters 24 and/or production configuration parameters 25, which have to be correspondingly configured in order that the relevant production strategy $PS_1$, $PS_n$ can be selected and activated in the relevant production run or respectively in the relevant production series, that is to say that the value of a relevant system configuration parameter 24 or production configuration parameter 25 must have at least the corresponding minimum value $SK_{11min}$, $SP_{1qmin}$, $SK_{n1min}$, $SP_{nqmin}$, and/or at most the corresponding maximum value $SK_{11max}$, $SP_{1qmax}$, $SK_{n1max}$, $SP_{nqmax}$.

The strategy selector 23 is designed to select and activate one of the stored production strategies 26 on the basis of the (current) stored system configuration parameters 24, the (current) stored production configuration parameters 25 and, if appropriate, the assigned configuration conditions and/or strategy assessments. Depending on the application and situation, the strategy selector 23 can change the production strategies 26 for example from one production series to the other or even within a production series, such that typically two successive production series have different production strategies 26 or even a single production series with a plurality of different production strategies 26 is produced.

In one embodiment variant, the strategy selector 23 is activated when there is a change in specific run time data for the dynamic selection of the production strategy 26, for example in the case of specific user inputs such as current (or forecast) weather data, or in the case of fault-indicating run time data such as production faults or failures of specific system components or other abrupt system configuration changes.

Alongside the function as an evaluation module, in one variant the strategy selector 23 additionally has the function of a monitoring module, that is to say that the strategy selector 23 does not just evaluate defined decision basis data for dynamically determining and activating a situationally optimum production strategy 26, but additionally detects at least certain of the decision basis data in the printed product processing system 100 and/or from the user.

In one embodiment variant, the strategy selector 23, before the selection of the production strategy 26, activates the system configurator 21 for detecting run-time-dependent system configuration parameters 24 of the printed product processing system 100.

In a first step, the strategy selector 23 determines the production strategies 26 which are selectable, by respectively checking whether the assigned configuration conditions of a production strategy $PS_1$, $PS_n$ are met by the current system or respectively production configuration, that is to say whether the current system configuration parameters 24 and/or production configuration parameters 25 correspond to the defined minimum and/or maximum values $SK_{11min}$, $SK_{11max}$, $SP_{1qmin}$, $SP_{1qmax}$, $SK_{n1min}$, $SK_{n1max}$, $SP_{nqmin}$, $SP_{nqmax}$ of the production strategy $PS_1$, $PS_n$. In one variant, production strategies 26 whose configuration conditions are not met by the current system configuration parameters 24 and/or production configuration parameters 25 are automatically deactivated and, for example, reactivated only when their configuration conditions are met.

If a plurality of selectable (or respectively non-deactivated) production strategies 26 are determined, in a second step the strategy selector 23 selects the production strategy 26 to be applied and to be activated, for example on the basis of the assigned strategy assessment of the relevant production strategy $PS_1$, $PS_n$, that is to say depending on which production strategy $PS_1$, $PS_n$ has a high assigned strategy priority value $P_1$, $P_n$ and/or a rejects value $A_1$, $A_n$ and/or performance value $L_1$, $L_n$ which best corresponds to a preferred strategy assessment contained in the production configuration parameters 25, in particular with a preferred rejects value and/or a preferred performance value.

In a further embodiment variant, the strategy selector 23, for the selection of the production strategy 26, additionally takes account of production state values of the current production run or respectively of the current production series such as, for example, the number of fed or respectively remaining products 3 of the feed conveyors 13, the number of faulty or respectively removed collections 4*, the number and position of incomplete collections 4', **4*a*', 41', the number of complete and excess product collections 4 and/or the number of created packs 40**.

The selected production strategy 26 is then applied or respectively implemented for controlling the printed product processing system 100, for example upon the detection of new or respectively changed run time data such as weather data, system faults or production faults, e.g. faults in compiling a product collection 4, in particular upon the detection of an incomplete collection 4' in which one or a plurality of products 3 are erroneously missing at the relevant location in the production or respectively production series.

Figure 2:
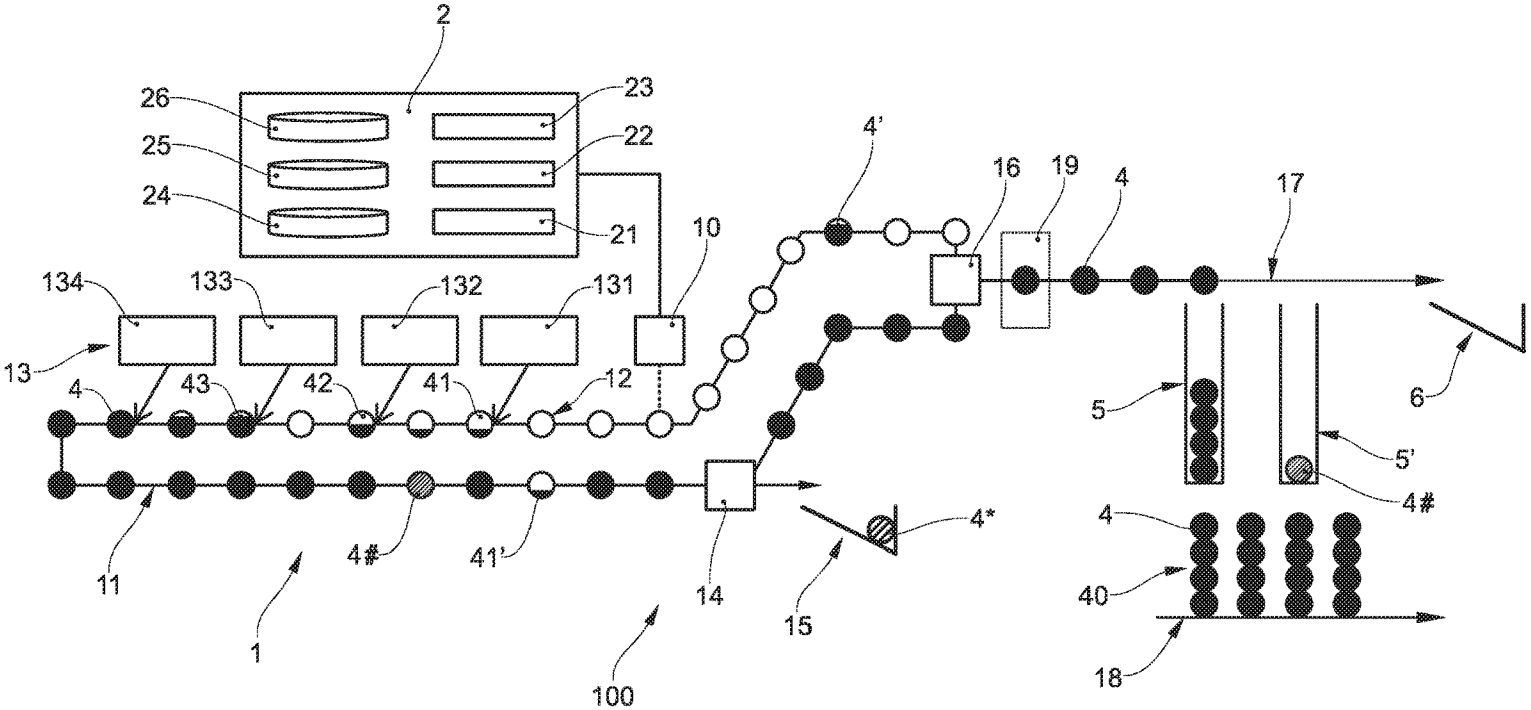
FIG. 2: shows a block diagram schematically illustrating the printed product processing system from FIG. 1 when compiling a plurality of products for a product collection of a specific collection type.

FIG. 2 illustrates the printed product processing system 100 during the production, wherein product collections 4 of one specific collection type are compiled in one running production series and product collections 4# of a collection type different from the collection type of the running production series are compiled in a subsequent production series.

As is illustrated schematically in FIG. 2, the feed conveyor 131 feeds a first product 41 to the conveyor 11, for example onto a collection carrier 12, for compiling the product collection 4. A respective further product is fed by the subsequent feed conveyors 132, 133, such that a partial collection 42 or respectively 43 is formed on the conveyor 11, for example in the relevant collection carrier 12, said partial collection being completed by the feed conveyor 134 by feeding a further product to the product collection 4. The product collections 4 are transported by the conveyor 17 to the stacking station 5, where they are stacked and the packs 40 created are led away.

On the conveyor 11, the reference sign 4# in FIG. 2 designates a product collection of a collection type which is different from the collection type of the running production series and which was produced in accordance with a selected production strategy 26 on the basis of an incomplete collection (partial collection), which was originally provided for compiling a product collection of the collection type of the running production series, but in the case of which failed product feeding was detected. This dynamic collection conversion strategy is selectable depending on the collection structures of successive production cycles and the occupancy and arrangement of the feed conveyors 13. A further condition for this is that the product collections 4# produced outside the regular order can be stacked by a separate stacking station 5' provided for this purpose, or that the product configuration parameters 25 define a tolerance of pack faults which tolerate product collections 4# having different collection types on a pack 40 of product collections 4. Depending on the feed conveyor 13 at which the product feeding fails, it may additionally be necessary for a tolerance for a deviating product order and/or additional products 3 in a product collection 4# additionally to have been specified for the collection conversion.

If the production strategy 26 is not selectable for a collection conversion, the incomplete collection 4', 41', in alternative production strategies 26 for completion, can be fed to an additional cycle or be removed as a faulty collection 4* by ejection, wherein, in the latter case, depending on the additional production specified, it is necessary to increase the production target for the product collections 4 of the relevant collection type.

Moreover, the two incomplete collections 4', 41' in FIG. 2 schematically illustrate different production strategies 26 for completing incomplete collections. The incomplete collection designated by 41', after the detection of failed product feeding, for example at the feed conveyor 132, without the feeding of further products by the subsequent feed conveyors 133, 134, was transported further on the conveyor 11 in order subsequently to be guided to an additional cycle on the conveyor 11 for completion with the missing products of the feed conveyors 132, 133, 134. This return, with an additional cycle on the conveyor 11, without prior feeding of products after fault detection, is selected, for example, if the product order in the product collection has to be complied with and conversion into a product collection 4# of a different collection type is not possible. By contrast, the incomplete collection designated by 4' in FIG. 2, after the detection of failed product feeding, for example at the feed conveyor 132, was supplemented with further products of the subsequent feed conveyors 133, 134 because in this hypothetical example the product order need not be complied with, and was then guided to an additional cycle for completion, for example by feed conveyor 132.

Figure 3:
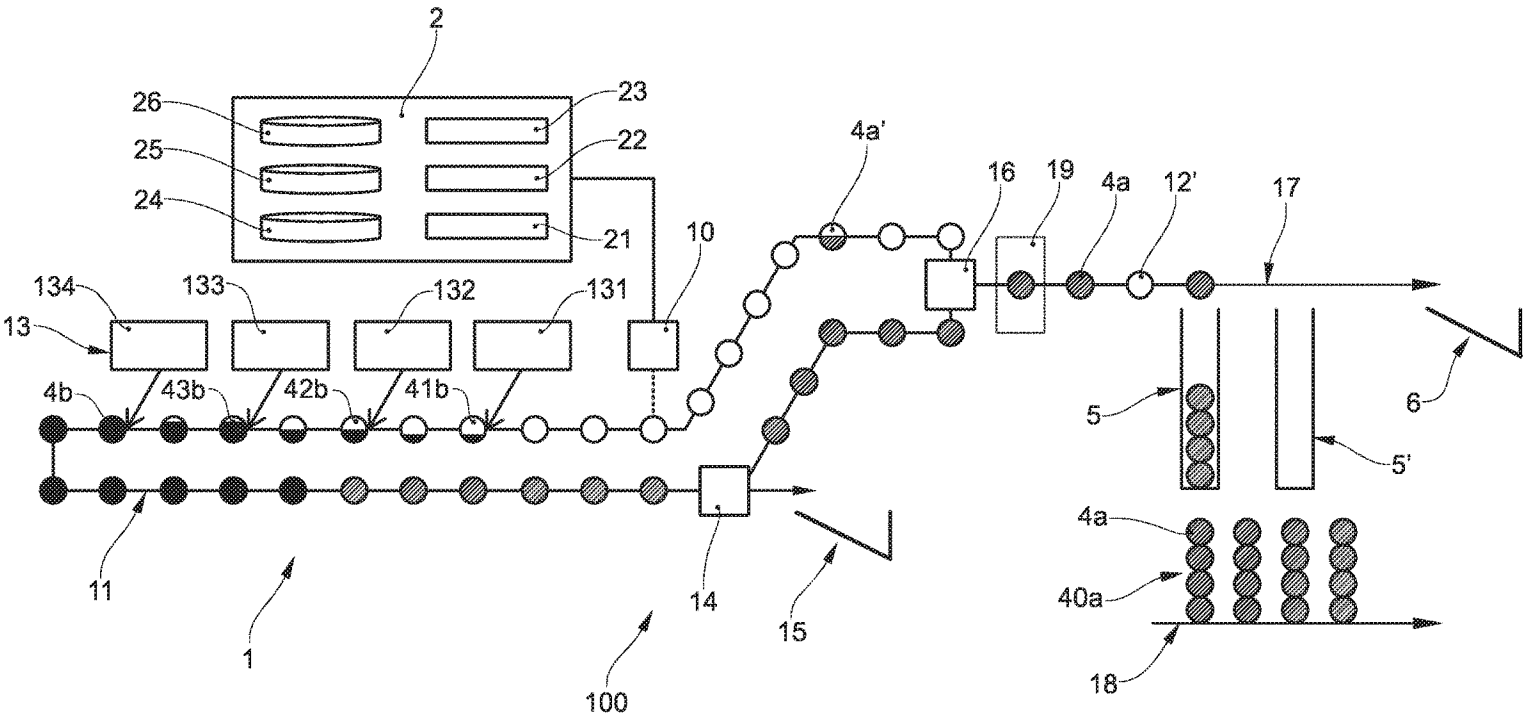
FIG. 3: shows a block diagram schematically illustrating the printed product processing system from FIG. 1 when compiling product collections having different collection types.

FIG. 3 illustrates the printed product processing system 100 during the production upon the transition from a first production series for product collections 4*a* of a first collection type to a subsequent second production series for product collations 4*b* of a second collection type. As is illustrated schematically in FIG. 3, the transition takes place seamlessly in the example in FIG. 3, for example without empty collection carriers 12 between the different product collections 4*a*, 4*b* on the conveyor 11. Depending on the production strategy, however, empty locations, for example empty collection carriers 12, can also be provided between the production series. As is evident in FIG. 3, the product collections 4*b* of the second collection type are compiled by the feed conveyors 13, as described above with reference to FIG. 2 for the product collections 4, sequentially via partial collections 41*b*, 42*b* and 43*b*, while the already fully compiled product collections 4*a* of the first collection type are transported by the conveyor 11 to the stacking station 5, where they are stacked to form packs 40*a* of the first collection type and are led away.

The example in FIG. 3 additionally illustrates how an incomplete collection 4*a*' of the first collection type is guided past the feed conveyors 13 once again on an additional cycle for completion, wherein the corresponding location on the conveyor 17, for example the corresponding collection carrier 12', remains empty (this can also be prevented with a variable advance of the conveyors 17). In the case of this simultaneous compiling of product collections 4*a*, 4*b* having different collection types, the incomplete collection 4*a*' will be transported after its completion on the conveyor 11 as product collection of the first collection type in the midst of product collections 4*b* of the second collection type to the stacking stations 5, 5'.

Figure 4:
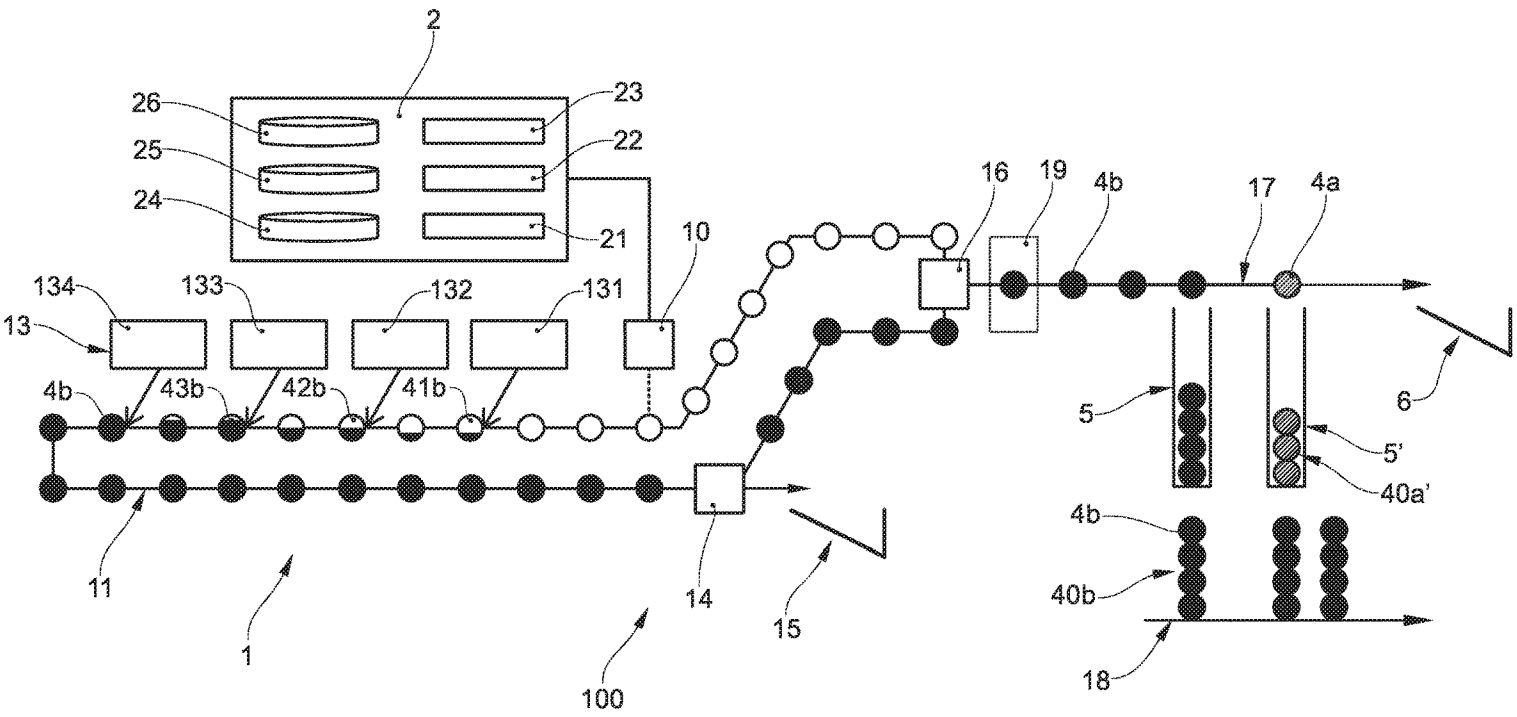
FIG. 4: shows a block diagram schematically illustrating the printed product processing system from FIG. 1 when compiling product collections having different collection types and during pack formation by means of a plurality of stacking stations.

As is illustrated in FIG. 4, the completed product collection 4*a* of the first collection type is fed by the conveyors 17 to the stacking station 5', which in this phase is provided for example for the (delayed) stacking of the product collections 4*a* of the first collection type and already contains an incomplete pack 40*a*' of product collections 4*a* of the first collection type, whereas the stacking station 5 is provided for the running creation of packs 40*b* having product collections 4*b* of the second collection type. The production strategy 26 with intermixed collection types on the conveyor 11 is not selectable if a plurality of stacking stations 5, 5' are not available or the packs 40*a*, 40*b* are not permitted to have product collections 4*a*, 4*b* having different collection types.

Figure 5:
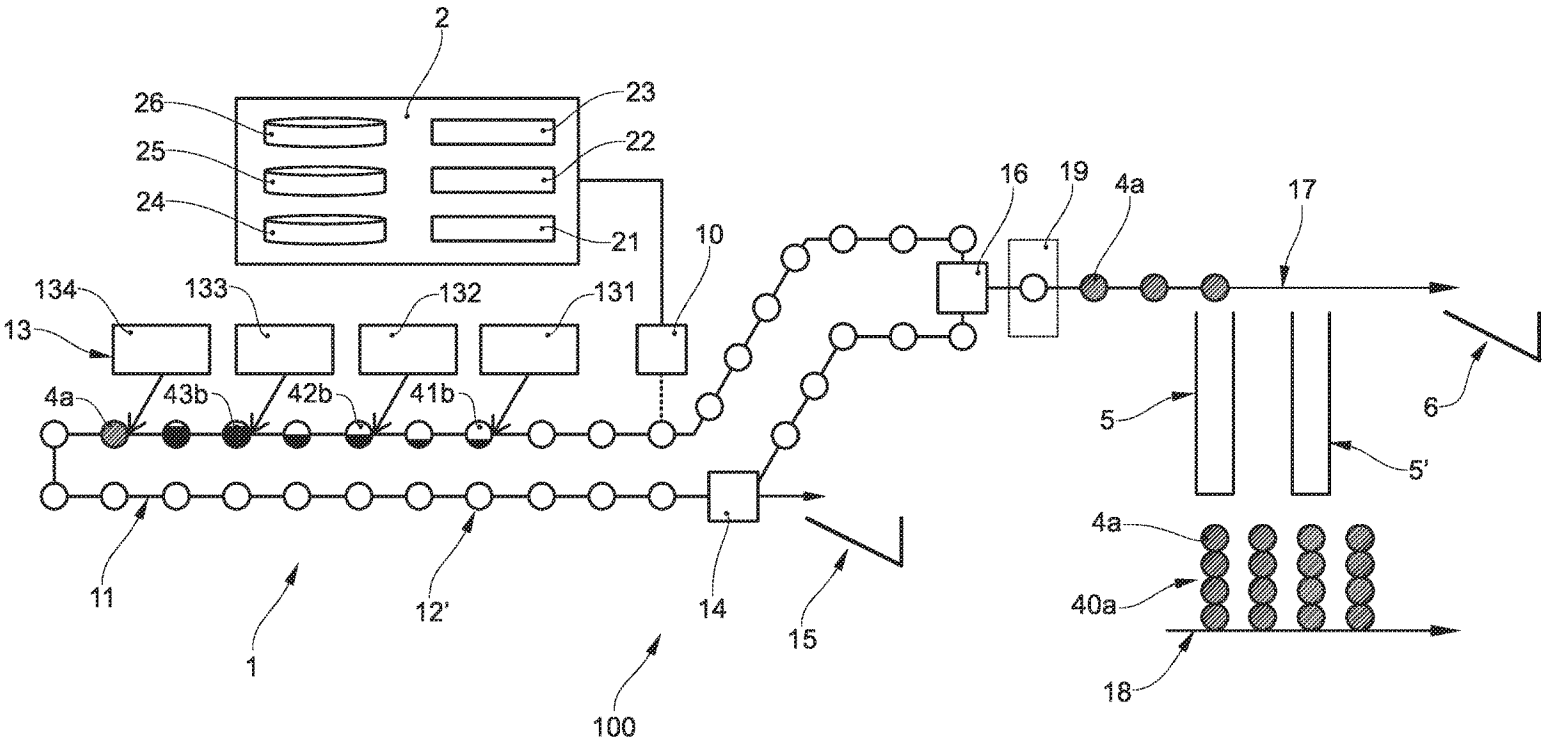
FIG. 5: shows a block diagram schematically illustrating the printed product processing system from FIG. 1 when compiling product collections having different collection types and during pack formation by means of one stacking station.

If the production strategy 26 with intermixed collection types on the conveyor 11 is not selectable, the production series for producing product collections 4*b* of the second collection type can be started only when the returned product collection 4*a* of the first collection type has been completed by the relevant feed conveyor, for example 134, as is illustrated schematically in FIG. 5. This production strategy 26 described above ensures, in the case of a single stacking station 5, homogeneous packs 40*a* with product collections 4*a* which uniformly have the first collection type, although to the detriment of the production performance, since in this case, numerous locations, for example collection carriers 12', on the conveyor 11 remain empty, as can be seen in FIG. 5, and the throughput quantity or respectively production speed is correspondingly reduced.

Besides the above-described production strategies 26 for the treatment of faulty collections including further guidance with or without feeding of further products, the maintenance or conversion of the collection type provided, completion with or without an additional cycle on the conveyor 11, ejection of partial collections with or without an increase in the production target, the beginning of a production series during or after the completion of partial collections of preceding production series, depending on the embodiment variant further production strategies 26 for controlling the printed product processing system 100 in the case of new or respectively changed run time data are provided, which are automatically selected and activated by the strategy selector 23 on the basis of the current system configuration parameters 24, the current production configuration parameters 25, the run time data determined and the assigned configuration conditions and/or strategy assessments, for example slowed-down further guidance and/or separation of the faulty collections with or without feeding of further products for the subsequent manual completion with the missing product or products.

It will finally be mentioned that although in the description computer program code was assigned to specific functional modules and the performing of steps was explained in a specific order, the person skilled in the art will understand that the computer program code can be structured differently and the order of at least certain steps can be changed, without in this case departing from the subject matter for which protection is sought.

LIST OF REFERENCE SIGNS

1 Collecting system
2 Computerized control device
3 Product
4,4*a*,4*b* Product collection
4', 4*a*' Incomplete product collection
4* Faulty product collection
4# Product collection having a different collection type
5, 5' Stacking station
6 Discharge station
10 Control computer
11 Conveyor
12, 12' Collection carrier
13 Feed conveyor
14 Reject diverter
15 Reject removal system
16 Controllable transfer unit
17, 18 Conveyor
19 Further processing system
21 System configurator
22 Production configurator
23 Strategy selector
24 System configuration parameter
25 Production configuration parameter
26 Production strategies
40,40*a*,40*b* Pack
40*a*' Incomplete pack
41 Product
41*b* Partial collection
41' Incomplete product collection
42,42*b*,43, 43*b* Partial collection
100 Printed product processing system
131,132,133,134 Feed conveyor

The invention claimed is:

1. A computerized control device for controlling a printed product processing system, which comprises a collecting system having a conveyor and a plurality of feed conveyors for creating product collections from products fed by the feed conveyors, the computerized control device comprising:

a system configurator for detecting and storing system configuration parameters which define a configuration of the printed product processing system, a production configurator for detecting and storing production configuration parameters which define a production of product collections created from a plurality of products fed, non-transitory computer storage having stored therein a plurality of stored production strategies which in each case specify the control of the printed product processing system, and which comprise at least one of stored instructions or control parameters for controlling the printed product processing system, wherein individual stored production strategies are assigned a strategy assessment, wherein the strategy assessment includes a priority value and at least one of an expected rejection value of faulty collections or an expected production performance value, wherein the priority value is indicative of whether a production strategy is preferred or subordinated relative to other production strategies of the plurality of stored production strategies, and a strategy selector, which is activated in response to a change in specific run time data for the dynamic selection of one of the stored production strategies, wherein the strategy selector is configured to select and to activate one of the stored production strategies for controlling the printed product processing system during the production on the basis of the stored system configuration parameters, on the basis of the stored production configuration parameters, the strategy assessment associated with the individual stored production strategies, and on the basis of run time data determined during the production, the strategy selector being configured to select one of the stored production strategies in response to run time data indicating a failure of a system component of the printed product processing system.

2. The computerized control device according to claim 1, characterized in that at least one of the system configurator or the production configurator is configured to detect and to store at least one of certain run-time-dependent system configuration parameters or production configuration parameters, respectively, during the production.

3. The computerized control device according to claim 1, characterized in that the run time data indicate a production fault that has occurred in the creation of a product collection and in that the strategy selector is configured to select the stored production strategy on the basis of the production fault.

4. The computerized control device according to claim 1, further comprises a means for determining run time data comprising a user interface, which is configured to receive and to store the run time data from a user during the production.

5. The computerized control device according to claim 1, characterized in that the stored production strategies bring about a different driving of the feed conveyors for a different feeding of the products.

6. The computerized control device according to claim 1, characterized in that the stored production strategies are configured to bring about a different driving of a transfer unit, which transfers a created product collection to a further processing system or leaves it on the conveyor and guides it past the feed conveyors once again.

7. The computerized control device according to claim 1, characterized in that the stored production strategies are configured to bring about a different driving of a reject diverter, which feeds a faulty product collection to a reject removal system or guides it further on the conveyor.

8. The computerized control device according to claim 1, characterized in that the stored production strategies are configured to bring about a different speed control of the conveyor.

9. The computerized control device according to claim 1, characterized in that a respective strategy assessment assigned to the stored production strategies is configured to be stored, and in that the strategy selector is configured to select one of the stored production strategies on the basis of the assigned strategy assessment.

10. The computerized control device according to claim 1, characterized in that the system configuration parameters comprise indications of at least one of the following number of feed conveyors, position of the feed conveyors, number of collection carriers, number of connectable stacking stations, position of the connectable stacking stations, number of reject diverters and position of the reject diverters, and in that the production configuration parameters comprise indications of at least one of the following number of product collections in a production, route information for delivery of packs having product collections, address information for delivery of packs or respectively product collections, number of empty positions on the conveyor between the production of different product collections, number of product collections in additional production, structure of a product collection, size of a product collection, number of products, occupancy of the feed conveyors, split operation of feed conveyors, treatment of excess product collections, tolerance of incorrect withdrawals per product, tolerance of product collection faults, tolerance of pack faults, tolerance of faults in product order, tolerance of additional products in a product collection, tolerance with regard to route conformity of packs, and tolerance with regard to route conformity of the order of the packs.

11. A computer implemented method for controlling a printed product processing system, which comprises a collecting system having a conveyor and a plurality of feed conveyors for creating product collections from products fed by the feed conveyors, the method comprising:

detecting and storing in a computerized control device system configuration parameters which define a configuration of the printed product processing system, detecting and storing in the computerized control device production configuration parameters which define a production of product collections created from a plurality of products fed, and determining in the computerized control device run time data during the production, by a process that comprises selecting in the computerized control device one of a plurality of stored production strategies, each of which specifies the control of the printed product processing system and is assigned a strategy assessment, wherein the strategy assessment includes a priority value and at least one of an expected rejection value of faulty collections or an expected production performance value, wherein the priority value is indicative of whether a production strategy is preferred or subordinated relative to other production strategies of the plurality of stored production strategies, each production strategy comprising at least one of instructions or control parameters for controlling the printed product processing system, during the production on the basis of the stored system configuration parameters, the stored production configuration parameters, the strategy assessment associated with the individual stored production strategies, and the run time data determined, and activating the selected stored production strategy for controlling the printed product processing system in response to a change in specific run time data for the dynamic selection of the stored production strategy, the run time data indicating a failure of a system component of the printed product processing system.

12. The method according to claim 11, characterized in that at least one of certain run-time-dependent system configuration parameters or production configuration parameters are configured to be detected and stored during the production.

13. The method according to claim 11, characterized in that the run time data indicate a production fault that has occurred in the creation of a product collection, and in that the stored production strategy is configured to be selected on the basis of the production fault.

14. The method according to claim 11, characterized in that the run time data are configured to be received from a user via a user interface and stored in the computerized control device during the production.

15. The method according to claim 11, characterized in that a control computer is configured to drive the feed conveyors differently on the basis of the stored production strategies in order to feed the products differently.

16. The method according to claim 11, characterized in that a control computer is configured to drive a transfer unit differently on the basis of the stored production strategies in order to transfer a created product collection to a further processing system or to leave it on the conveyor and to guide it past the feed conveyors once again.

17. The method according to claim 11, characterized in that a control computer is configured to drive a reject diverter differently on the basis of the stored production strategies in order to feed a faulty product collection to a reject removal system or to guide it further on the conveyor.

18. The method according to claim 11, characterized in that a control computer is configured to drive the conveyor differently on the basis of the stored production strategies in order to achieve a different speed of the conveyor.

19. The method according to claim 11, characterized in that configuration conditions assigned to the stored production strategies are stored, which comprise at least one of defined minimum or maximum values for at least one of specific system configuration parameters or production configuration parameters, and in that one of the stored production strategies is selected depending on whether the assigned configuration conditions are met.

20. The method according to claim 11, characterized in that a respective strategy assessment assigned to the stored production strategies is stored, and in that one of the stored production strategies is selected on the basis of the assigned strategy assessment.

21. The method according to claim 11, characterized in that for the production of different product collections in successive production series, a different production strategy is selected in each case.

22. A computer program product, comprising a non-transitory tangible computer readable storage medium with stored computer code, which is configured to control one or a plurality of processors of a control device for controlling a printed product processing system which comprises a collecting system having a conveyor and a plurality of feed conveyors for creating product collections from products fed by the feed conveyers, such that the processors are configured to:

detect and store system configuration parameters which define a configuration of the printed product processing system, detect and store production configuration parameters which define a production of product collections created from a plurality of products fed, determine run time data during the production, select one of a plurality of defined production strategies which in each case determine the control of the printed product processing system and is assigned a strategy assessment, wherein the strategy assessment includes a priority value and at least one of an expected rejection value of faulty collections or an expected production performance value, wherein the priority value is indicative of whether a production strategy is preferred or subordinated relative to other production strategies of the plurality of stored production strategies, and which comprise at least one of stored instructions or control parameters for controlling the printed product processing system, during the production on the basis of the stored system configuration parameters, the stored production configuration parameters, the strategy assessment associated with the individual defined production strategies, and the run time data determined, and activate the selected defined production strategy for controlling the printed product processing system in response to a change in specific run time data for the dynamic selection of the defined production strategy, the run time data indicating a failure of a system component of the printed product processing system.

23. A computerized control device for controlling a printed product processing system, which comprises a collecting system having a conveyor and a plurality of feed conveyors for creating product collections from products fed by the feed conveyors, the computerized control device comprising:

a system configurator for detecting and storing system configuration parameters which define a configuration of the printed product processing system, a production configurator for detecting and storing production configuration parameters which define a production of product collections created from a plurality of products fed, and non-transitory computer storage having stored therein a plurality of stored production strategies which in each case specify the control of the printed product processing system and is assigned a strategy assessment, wherein the strategy assessment includes a priority value and at least one of an expected rejection value of faulty collections or an expected production performance value, wherein the priority value is indicative of whether a production strategy is preferred or subordinated relative to other production strategies of the plurality of stored production strategies, and which comprise at least one of stored instructions or control parameters for controlling the printed product processing system, and a strategy selector, which is activated in response to a change in specific run time data for the dynamic selection of one of the stored production strategies, wherein the strategy selector is configured to select and to activate one of the stored production strategies for controlling the printed product processing system during the production on the basis of the stored system configuration parameters, on the basis of the stored production configuration parameters and on the basis of run time data determined during the production, and the strategy selector being configured to select one of the stored production strategies in response to the strategy assessment associated with the individual stored production strategies, and run time data comprising run-time-dependent parameters or variables of the printed product processing system which are not known before the commencement of the production.

* * * * *